US005713637A

United States Patent [19]

Worden et al.

[11] Patent Number: 5,713,637

[45] Date of Patent: Feb. 3, 1998

[54] FLOOR COVERING REMOVAL APPARATUS

[76] Inventors: David W. Worden, 2119 NW. 198th St., Seattle, Wash. 98177; Richard A. Worden, 5116 1/2 Ravenna Ave. NE., Seattle, Wash. 98105

[21] Appl. No.: 657,965

[22] Filed: Jun. 4, 1996

[51] Int. Cl.[6] ..... E21C 47/00; B32B 31/18

[52] U.S. Cl. ..... 299/37.1; 15/93.1; 30/170

[58] Field of Search ..... 299/36.1, 37.1; 30/170; 15/93.1

[56] References Cited

U.S. PATENT DOCUMENTS

| | | | |
|---|---|---|---|
| 914,202 | 3/1909 | Tash | 30/170 |
| 2,005,630 | 6/1935 | Overell | 30/170 X |
| 3,779,605 | 12/1973 | Nieman | 299/37.1 |
| 4,162,809 | 7/1979 | Anderson et al. | 299/37.1 |
| 4,669,784 | 6/1987 | Grasse | 299/37.1 |
| 4,837,933 | 6/1989 | Chapman | 30/170 |
| 5,002,629 | 3/1991 | Nakamura | 156/584 |
| 5,037,160 | 8/1991 | Ukai | 299/37.1 |
| 5,082,330 | 1/1992 | Holder | 299/37.1 |
| 5,197,784 | 3/1993 | Holder | 299/37.1 |

*Primary Examiner*—David J. Bagnell
*Attorney, Agent, or Firm*—Steven P. Koda

[57] ABSTRACT

A walk behind tractor with a power take-off is combined with a blade assembly support assembly and lift assembly. The blade assembly allows a blade to be set at an adjustable angle. The support assembly supports added weight for increasing the force on the blade. Rollers are provided at points of contact between the support assembly and blade assembly to allow movable points of contact. A rolling movement accommodates the downward force of applied weight without tearing at the blade assembly along a transverse direction during oscillation. The lift assembly raises the tractor front end moving the blade out of contact with the floor and floor covering.

12 Claims, 8 Drawing Sheets

FLOOR COVERING REMOVAL APPARATUS

BACKGROUND OF THE INVENTION

This invention relates to floor covering removal machines, and more particularly to a floor covering removal machine that can be used effectively indoors on floors having different base material hardness and different floor covering materials.

Removing floor covering material affixed to an underlying floor can be a tedious task. Several floor covering removal machines have been proposed as disclosed in U.S. Pat. Nos. 5,197,784 (Holder); 5,082,330 (Holder); 5,037,160 (Ukai); 5,002,629 (Nakamura); 4,669,784 (Grasse); and 4,162,809 (Anderson et al.). Of these several are large machines ridden by an operator. Grasse and Anderson et al. disclose machines of significantly less weight in which the operator walks behind the machine. A problem with the riding machines is that their size makes them difficult to use and maneuver in indoor areas. An advantage is that the large machines are able to generate large forces for stripping the floor covering. A problem with the lighter weight 'walk-behind' machines is that they do not generate as much power for stripping floor covering and thus are less effective at stripping tiles and carpeting secured by adhesives or epoxies. An advantage of the walk-behind machines is that they are smaller, can fit into smaller areas and are more maneuverable than the larger machines. Accordingly, there is a need for a floor covering removal machine which has the power of the larger riding machines disadvantages of the large size and comparatively poorer maneuverability.

SUMMARY OF THE INVENTION

One problem addressed by the invention is the need for substantial power and maneuverability in a floor covering removal apparatus. This problem is solved by outfitting a powerful walk behind tractor with effective floor covering removal mechanisms. By basing the apparatus on a walk behind tractor, a smaller machine results. One advantage is that the machine can fit into smaller areas (e.g., indoor office environments) with increased maneuverability.

According to the invention, a blade assembly, weighted support assembly and lift assembly are mounted onto the tractor. The blade assembly includes a blade which acts upon a floor to remove floor covering. The support assembly is mounted at the front end of the tractor and provides added weight for increasing force on the blade. The lift assembly moves the blade between a lowered operational position and a raised non-operational position.

One challenge in having a weighted front end is the ability to support the weight without damaging the blade assembly upon which the weight acts. According to one aspect of the invention, points of contact between the weighted support assembly and the blade assembly are established at a pair of rollers. The rollers are attached to and part of the support assembly. In one mode of operation the blade assembly oscillates to aid in removing floor covering material. The rollers enable movement of the points of contact on the blade assembly during oscillation. A rolling movement accommodates the downward force of the weight without tearing, shearing force occurring along a transverse direction of the blade assembly. Such accommodation is particularly advantageous during oscillation of the bade.

According to another aspect of the invention, the lift assembly serves to raise the front end of the tractor, along with the support assembly and blade assembly out of an operating position into a raised non-operational position. In the operating position the blade makes contact with the floor and floor covering. In the non-operational position the blade is moved out of contact with the floor and floor covering. Raising the blade improves the apparatus maneuverability when positioning before, between and after floor covering removal.

Another challenge for a floor covering removal apparatus is to provide versatility. Different floor coverings and different floor substrates have different hardness. According to another aspect of the invention, an angle formed between the blade and the floor substrate is adjustable. During operation the blade is fixed at a set angle. The blade is adjustable to be set at differing blade angles. The inventors have discovered that the effectiveness of floor covering removal varies for differing floor materials, floor hardness and blade forces. More specifically, an optimum blade angle may differ according to the floor hardness, blade force or floor covering material. Effectively operating the apparatus with a given weight and a given blade angle on one floor may result in damage to another floor. Accordingly, the blade angle is adjusted to improve performance. The operator determines the blade angle to be used based upon the floor hardness, the floor covering material and the weight applied to the support assembly.

According to a preferred embodiment, the floor covering removal apparatus is combined with a tractor. The combination includes a tractor body, a plurality of wheels mounted to the tractor body, a motor mounted to the tractor body for driving the plurality of wheels, a blade assembly and a support assembly. The blade assembly is coupled to the tractor body at a forward portion of the tractor body, and includes a blade for contacting floor covering to be removed from a floor. The support assembly is mounted to the tractor body or blade assembly. The support assembly has at least a first contact point and a second contact point with the blade assembly for applying excess force to the blade. The support assembly includes a first roller defining a first contact point and a second roller defining a second contact point. The first contact point and second contact point are movable along the blade assembly.

The motor has a power take-off for driving oscillation of the blade via an eccentric shaft. The first contact point and second contact point move along the blade assembly during oscillation of the blade.

In addition to the blade, the blade assembly includes: a hinge to which the blade is attached, a base plate to which the hinge is attached, a first arm fixedly connected to the base plate, a second arm fixedly connected to the base plate, a first rail for receiving the first arm, and a second rail for receiving the second arm. The first rail and the second rail are secured to the tractor body. An angle between the base plate and hinge adjustable, thereby providing an adjustable blade angle.

The blade includes a first plate connected to a second plate. The first plate defines a distal edge for contacting the floor covering. The second plate is attached to the hinge. For adjusting the angle, the blade assembly further includes, a first bolt extending from the base plate through the second plate where the first bolt is locked into position to define the blade angle. The first bolt prevents variation of the blade angle in a first direction during operation. A second bolt is included which extends through the second plate to the base plate to prevent variation of the angle in a second direction counter to the first direction.

The support assembly first contact point is movable along the first arm of the blade assembly. The support assembly second contact point is movable along the second arm of the blade assembly. The support assembly further includes a support surface elevated relative to the blade assembly for receiving added weight. A first support wall and a second support wall support the elevated surface relative to the blade assembly. The first roller is mounted to the first support wall. The second roller is mounted to the second support wall.

The floor covering removal apparatus also includes a lift assembly for lifting the support assembly and blade assembly to move the blade into a raised non-operational position out of contact with the floor and floor covering. The lift assembly includes a frame having a first leg and a second leg connected by a cross beam. A first bar extends from the first leg to the second leg and defines an axis of rotation for the frame. The first bar is coupled to the tractor and support assembly. The lift assembly also includes a first wheel coupled to the first leg at a distal portion of the first leg, and a second wheel coupled to the second leg at a distal portion of the second leg. A second bar extends from the first leg to the second leg. A hydraulic jack moves the second bar toward the forward end of the tractor. Such motion causes a rotation of the frame about the frame axis of rotation and forces the first wheel and second wheel downward toward the floor. The forward end of the tractor with the support assembly and the blade assembly is driven upward from the floor as the force on the wheels and the rotation of the frame continues. The weight of the support assembly and blade assembly is shifted from the blade to the first wheel and second wheel of the lift assembly.

According to one advantage of the invention, the floor covering removal apparatus is of a desirable size for operating in indoor areas. According to another advantage of the invention, the floor covering removal apparatus has a weighted front end for increasing the force on the blade as floor covering is removed. According to another aspect of the invention, points of contact at which the excess weight is applied to the blade assembly are made at rollers allowing movement of the points of contact laterally without damage to component structures. According to another advantage of the invention, the blade is raised to improve maneuverability when floor covering is not being removed. According to another advantage of the invention, the blade angle although set during operation, is adjustable to provide effective performance for various floor substrates and floor covering materials.

These and other aspects and advantages of the invention will be better understood by reference to the following detailed description taken in conjunction with the accompanying drawings.

DESCRIPTION OF SPECIFIC EMBODIMENTS

Overview

Figure 1:
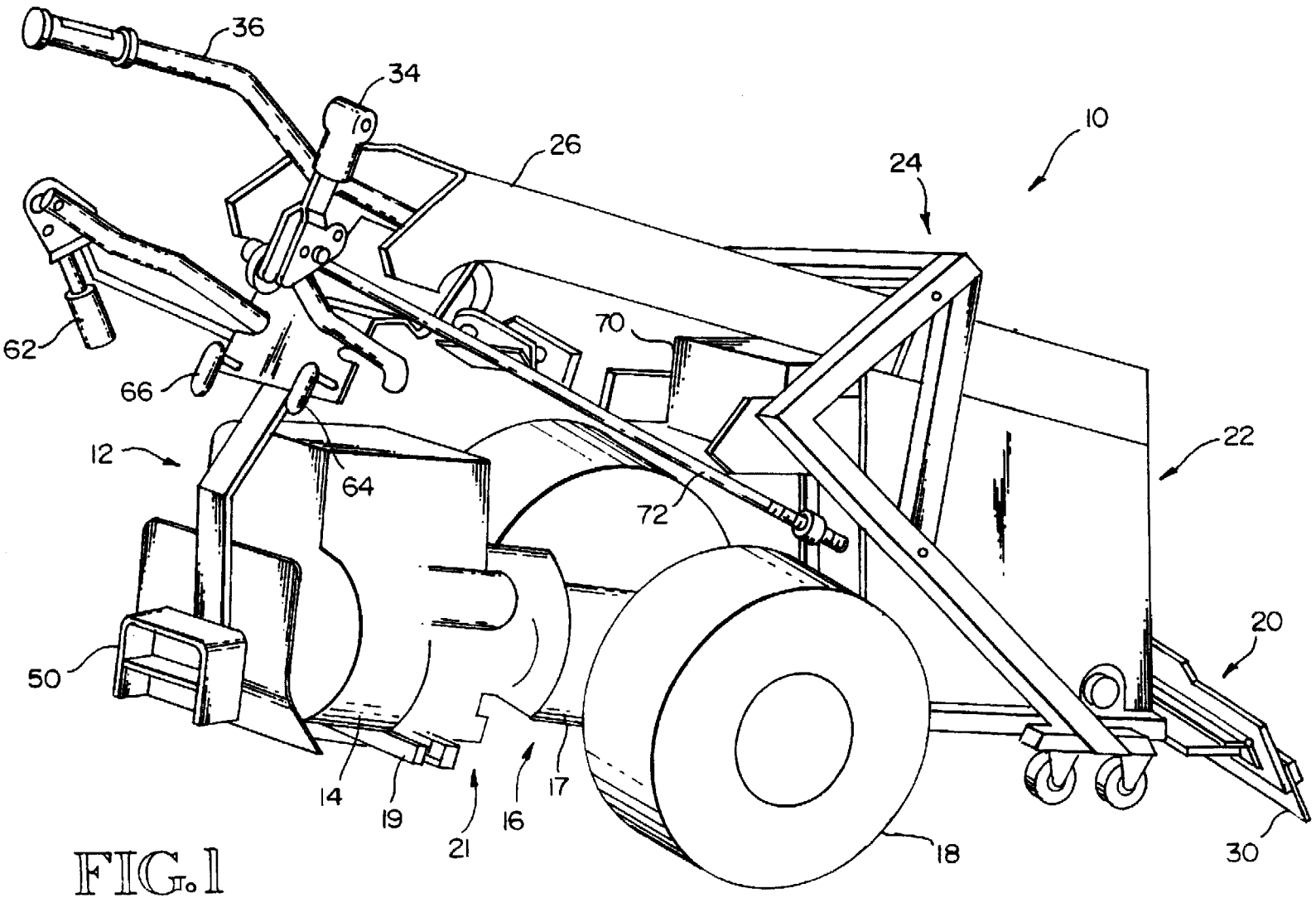
FIG. 1 is an isometric view of a floor covering removal apparatus according to an embodiment of this invention.

Referring to FIG. 1, the floor removal apparatus 10 includes a conventional walking tractor 12 fitted with mechanisms to enable floor covering removal. The tractor 12 is shown alone in FIG. 2 to include a motor 14, drive train 16 and wheels 18. Steering, clutch and gear mechanisms are included. A drive train casing 17 and motor support 19 define a tractor body 21. To form the floor covering removal apparatus 10 of FIG. 1, a blade assembly 20, support assembly 22, and lift assembly 24 are added to the tractor 12, along with a tractor hood 26. A blade 30 formed as part of the blade assembly 20 is forcibly wedged between a floor substrate and floor covering during operation. As the tractor moves forward a force is applied to the floor covering via the blade 30 to separate the floor covering from the floor substrate.

Exemplary floor substrates include wood, stone materials (e.g., marble, slate, granite), and concrete based materials. The different floor substrate materials exhibit different hardness. Even among various concrete mixtures there are different hardness. Hardness of the substrate impacts the floor covering removal process and the ability of the floor substrate to withstand certain forces without damage. Exemplary flooring covering materials include glued down carpet, vinyl tile, asbestos tile, parquetry tile and adhesive materials. The different floor covering materials also exhibit different hardness. The various materials and adhesives also exhibit various forces of adhesion between the floor substrate and the floor covering materials.

Figure 3:
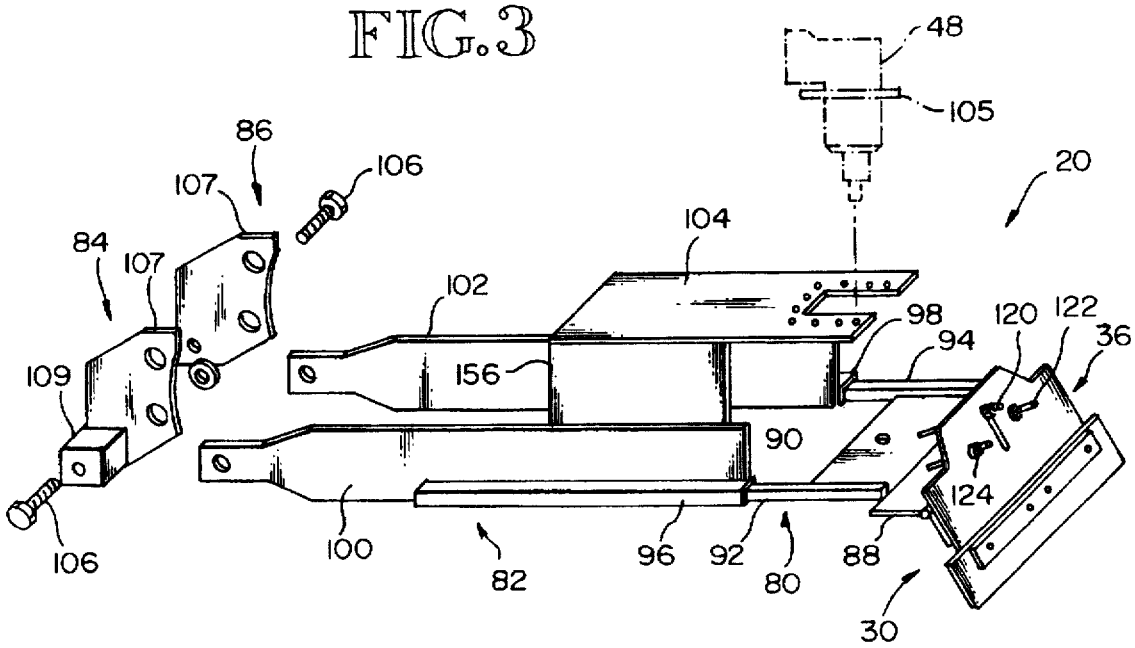
FIG. 3 is an isometric view of the blade assembly of the apparatus of FIG. 1.

The blade assembly 20 is mounted to the tractor 12 and includes the blade 30, mechanisms for adjusting an angle of the blade 30 relative to the floor substrate, a rail portion 80, and a frame 82 (see FIG. 3). The support assembly 22 includes a box-like nose structure 32 supporting added weight 34 (see FIG. 6). During operation an operator controls the tractor 12 motion and direction using a conventional clutch mechanism 34 and steering mechanism 36. An operator engages the tractor 12 into gear and steers the tractor 12 as the tractor moves forward. The blade 30 is positioned between the floor substrate and the floor covering. Force is applied to the floor covering via the blade 30. Such force is determined by the motion and power of the tractor 12, the weight applied to the blade assembly 20 by the support assembly 22, and the angle of the blade 30 relative to the floor substrate. As the tractor 12 moves forward, the blade separates the floor covering from the floor substrate. In one mode a portion of the blade assembly 22 is oscillated to provide further aid in separating the floor covering from the underlying floor substrate.

A lift assembly 24 is included for moving the support assembly 22 and blade assembly 20 between an operating position and a non-operating position. In the operating position the blade 30 is down on the floor where it can establish a contact between the floor substrate and floor covering. In the non-operating position, the blade 30 is elevated above the floor. Following are further descriptions of the tractor 12 and assemblies 20, 22, 24, along with a discussion of the floor covering removal apparatus 10 method of operation.

Tractor

Figure 2:
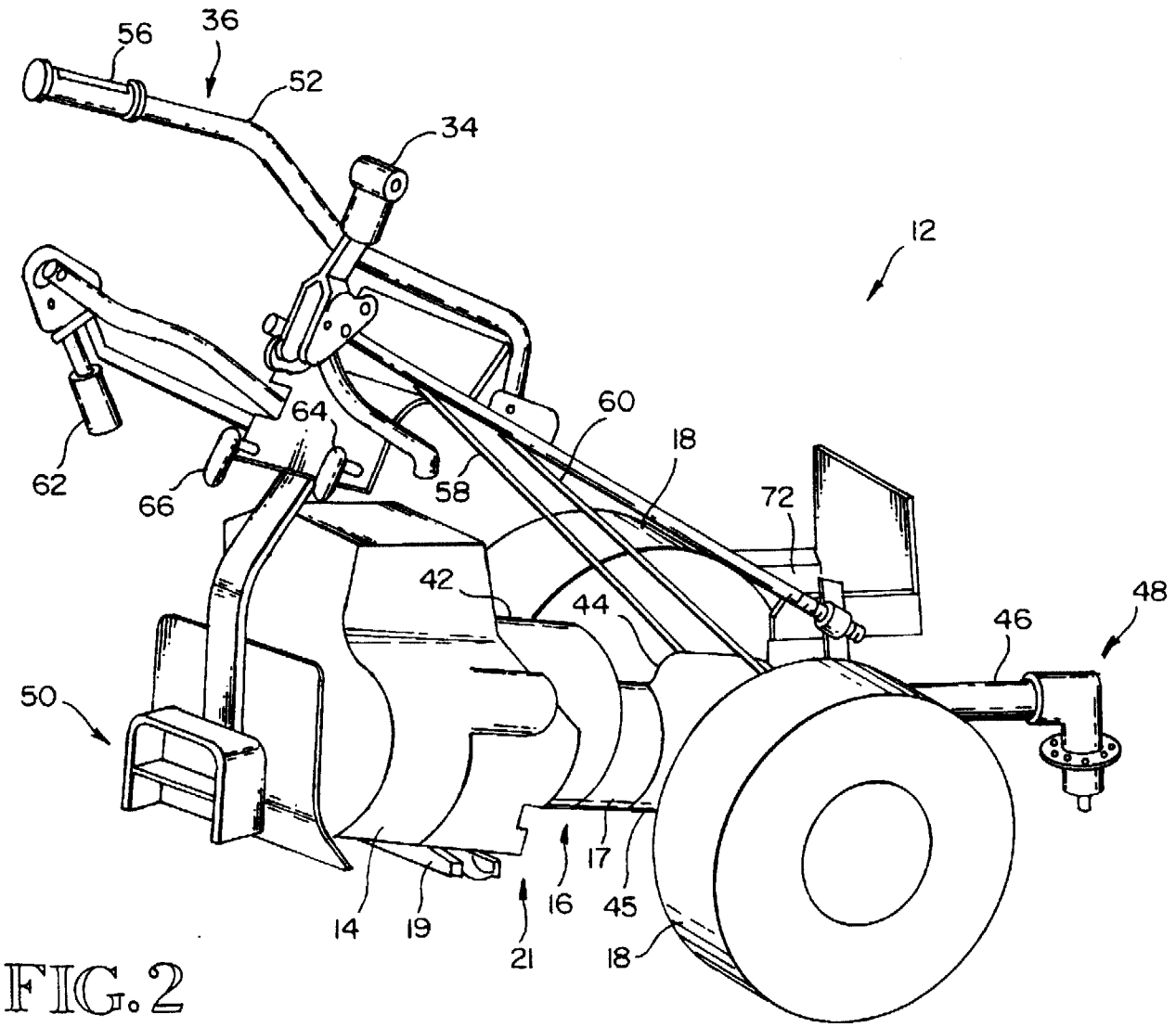
FIG. 2 is an isometric view of a conventional walk-behind tractor.

FIG. 2 shows a conventional tractor 12 before the blade assembly 20, support assembly 22 and lift assembly 24 are added. The tractor 12 includes a motor 14 and a drive train 16. In various embodiments the motor is of differing power (e.g., 6 horsepower, 8 horsepower). The motor is mounted to the drive train 40 and is supported by a frame 19. The drive train 16 includes a gear box 42, universal joint 44, power take-off shaft 46 and power take-off 48. A casing 17 surrounds the drive train 40. In one embodiment the gear box 42 and universal joint 44 include gear devices for implementing multiple gears (e.g., 2 gears; 4 gears). Wheels 18 are mounted to an axle (not shown) running through the drive train 40 at an axle casing 45. A hitch 50 is included in some embodiments (e.g., to which an operator seat may be attached). In one embodiment the tractor 12 is adapted to run off a propane source 70 (see FIG. 1) mounted onto a shelf 72 (see FIG. 2). The drive train casing 17 and motor support 19 define a tractor body 21. In other embodiments the tractor body is formed by a tractor frame to which various components of the tractor are mounted.

The tractor 12 also includes several control mechanisms. A single steering arm 52 is included in one embodiment of the steering mechanism 36, although two steering arms or a steering wheel are included in other embodiments. Typically a "dead-man" switch 56 is included preventing the tractor 12 from running when not held down by the operator. In one embodiment the steering mechanism 36 controls direction of the tractor by braking one or the other of the two wheels 18 via linkages 58, 60. A clutch mechanism 34 is included for idling the tractor in neutral and for engaging the tractor into forward or reverse gear directions. A gear shift 62 allows an operator to switch between two gears. A switch 64 also is included in some embodiments to switch between gear sets. For example, when switch 64 is in a first position, gear shift 62 is controlled by the operator to switch between a first gear and a second gear. When switch 64 is moved to a second position, the gear shift 62 is controlled to switch between a third gear and a fourth gear. Another control is the power take-off control 66. When the power take-off control 66 is in a first position, the power take-off 48 is not engaged. When the power take-off control 66 is in a second position, the power take-off 48 is engaged.

Blade Assembly

FIG. 3 shows the blade assembly 20, along with the tractor's power take-off 48. The blade assembly 20 includes a blade rail portion 80, a frame portion 82 and mounts 84, 86. The blade rail portion 80 is received into the frame portion 82, which is mounted to the tractor via mounts 84, 86. The blade assembly 20 is further mounted to the tractor at power take-off 48.

The blade rail portion 80 include the blade 30, hinge 88, base plate 90, and arms 92, 94. The blade 30 is mounted, welded or otherwise attached to the hinge 88. Hinge 88, in turn is mounted, welded or otherwise attached to the base plate 90. The frame portion 82 includes tube tracks 96, 98 for receiving the arms 92, 94. In one embodiment the arms 92, 94 are one inch solid steel in square configuration extending for approximately 1 to 2 feet. The arms 92, 94 are spaced by the base plate 90. The base plate 90 provides a separation of approximately 10.5 inches between the arms 92, 94 and extends a length of approximately 6 inches. The tracks 96, 98 are of corresponding tubular square configuration for mating with the arms 92, 94.

The frame portion 82 further includes two elongated members 100, 102. In one embodiment the members 100, 102 are formed with 0.5 inch thick steel. Welded, integrally formed or otherwise attached to member 100 is track 96. Similarly, welded, integrally formed, or otherwise attached to member 102 is track 98. The elongated members 100, 102 are spaced by a raised steel shelf 104 which fastens to a flange or collar 105 about the power take-off 48. At one end of each member 100, 102 the tracks 96, 98 receive the blade rail arms 92, 94. The opposite end of each member 100, 102 tapers to mate into a corresponding mount 84, 86.

In one embodiment, each mount 84, 86 is bolted to the tractor body 21 at respective sides of the axle casing 45 in the vicinity of the wheels 18. Each mount 84, 86 includes a plate portion 107 contoured to fit to the axle casing 45 and a female receptacle 109 for receiving the tapered end of an elongated member 100, 102. A bolt 106 secures the member 100/102 to the mount 84/86.

Figure 4:
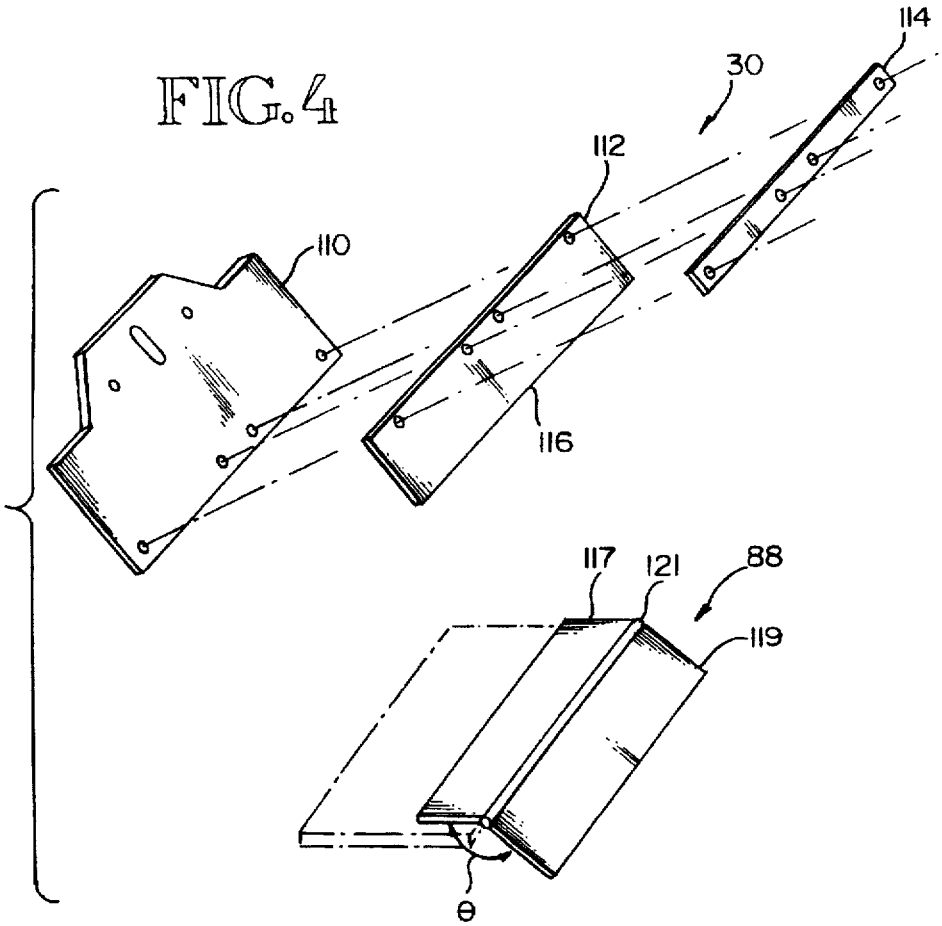
FIG. 4 is an exploded view of the blade portion of the blade assembly of FIG. 3.
Figure 5:
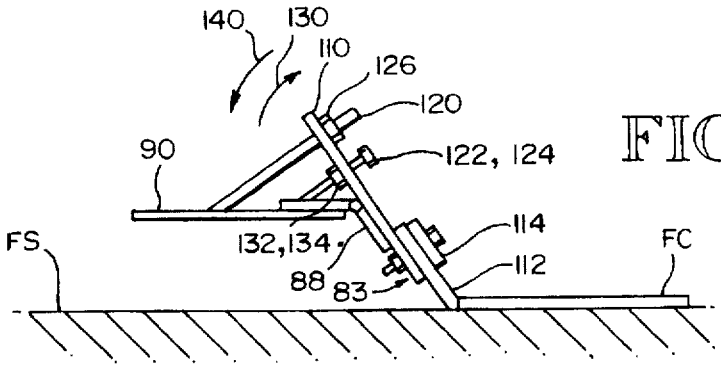
FIG. 5 is a planar side view of the blade, hinge and base plate of FIG. 3.

The blade 30 is shown in more detail with hinge 88 in FIGS. 4, and 5. The blade 30 includes a guide plate 110, a blade plate 112 and a brace 114. The guide plate is a plate of approximately 0.5 inch steel mounted, welded or otherwise attached to the hinge 88. The blade plate 112 is bolted to the guide plate 110, being sandwiched between the guide plate 110 and the brace 114. In one embodiment the blade 112 and brace 114 are formed of 0.5 inch thick steel. The blade plate 112 defines a distal edge 116 for contacting the floor substrate and floor covering material.

The hinge 88 includes a first portion 117 and a second portion 119 which move relative to each other about a hinge axis 121 to define a hinge angle $\theta$. In one embodiment the hinge 88 extends 15 inches across with each hinge portion 117, 119 having a width of 2 inches. A 0.5 inch pin defines the hinge axis 121. The guide plate 110, which is attached flush to the hinge portion 119, and the blade plate 112, which is attached flush to the guide plate 110, exhibit the same angle $\theta$. Because the hinge portion 117 is attached flush to the base plate 90, the blade plate 112 (and blade 30) also exhibits the angle 0 relative to the base plate 90. In embodiments in which the frame portion 82 of the blade assembly 22 is mounted to the tractor 12 so as to extend generally parallel to the floor substrate, the blade plate 112 and blade 30 define a blade angle $\alpha$ which is approximately $180°-\theta$ relative to the floor substrate FS and floor covering FC.

Because the hinge angle $\theta$ is adjustable, the blade angle $\alpha$ is adjustable. Referring to FIG. 5, the hinge angle and blade angle are set via bolts 120, 122, 124. Bolt 120 extends from base plate 90 through the guide plate 110 and is secured by a nut 126 mounted on the forward/upper side of the blade guide plate 110. Such bolt 126 limits the blade angle and the angular motion of the blade 30 in a first direction 130. The bolts 122, 124 are screwed through the guide plate 110 to a desired depth where contact is made with the hinge 88 or base plate 90. Such bolts 122, 124 then are locked off via nuts 132, 134 to define such desired depth. The bolts 122, 124 being locked into position limit the blade angle and angular motion of the blade 30 in an opposite direction 140.

Figure 6:
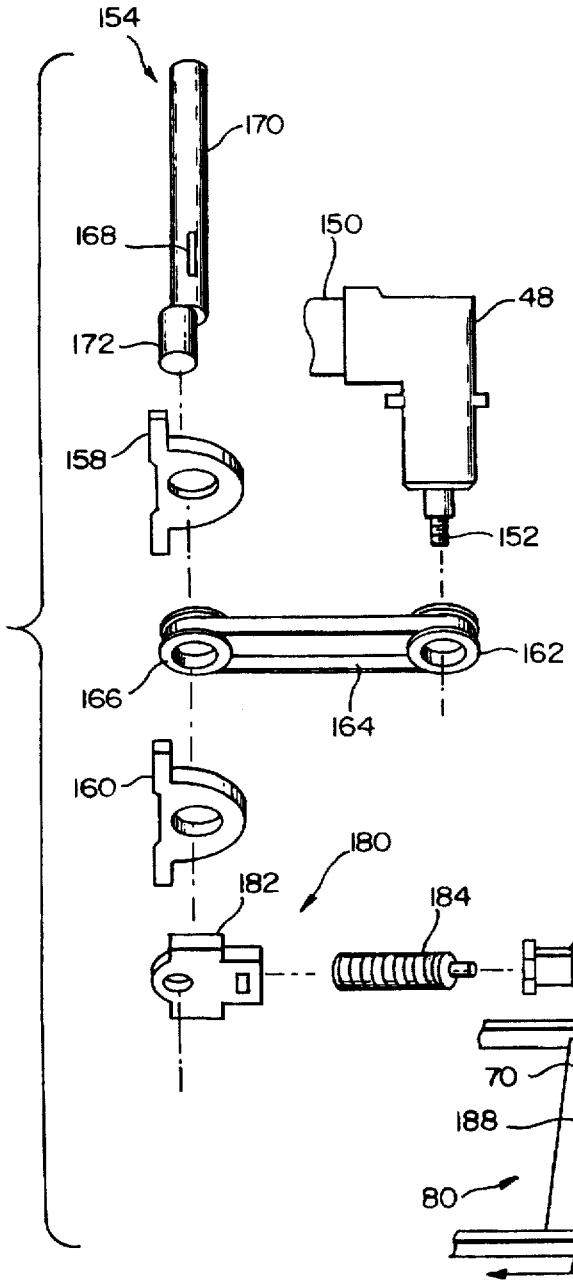
FIG. 6 is an exploded view of the mechanisms for oscillating the blade assembly of FIG. 3.

In one mode the blade 30 oscillates. FIG. 6 shows the power take-off 48 and linkage for moving the blade rail portion 80 of the blade assembly 22 in an oscillating motion so as to translate the oscillation to the blade 30. A drive shaft 150 off the drive train 16 is received into the power take-off 48. When the power take-off is engaged, the drive shaft 150 spins a power take-off shaft 152. An eccentric shaft 154 is driven by the power take-off shaft 152 via a wheel 162, 166 and belt 164 coupling. The eccentric shaft 154 is mounted to a steel wall 156 extending between members 100, 102 of the frame portion 82 of blade assembly 20. The steel wall 156 supports the shelf 104 of the frame portion 82 of blade assembly 22. Mounts 158, 160 along the wall 156 guide the shaft 154. Wheel 162 is mounted to the power take-off shaft 152 and is rotated by such shaft 152. The belt 164 couples the rotating motion of shaft 152 and wheel 162 to the wheel 166. The motion of the wheel 166 spins the eccentric shaft 154. The eccentric shaft 154 includes an alignment pin 168 for preventing slippage of the shaft 154 as the wheel 166 rotates.

In one embodiment the eccentric shaft 154 is 9 inches long and has a diameter of 1.5 inches. Along a first elongated portion 170 there is an axis of rotation which coincides with the radial center of the such portion 170. Such elongated portion extends approximately 7.5 inches. The remainder of the shaft 154 is formed by a shorter shaft portion 172, also having a diameter of 1.5 inches. The radial center of the shorter portion 172 is offset from the radial center of the elongated portion 170. As the shaft 154 spins, the axis of rotation along the shorter portion 172 is away from its radial center. A connecting rod 180 coupled to the shorter portion 172 is given a reciprocating oscillatory motion along an x axis due to the eccentric motion of the shorter portion 172.

In one embodiment the rod 180 is formed in three pieces 182, 184, 186 allowing the rod 180 length to vary. The length of the connecting rod 180 is set upon installation. One end of rod 180 couples to the eccentric shaft 154. The other end of rod 180 fastens to a pin 188 on the base plate 90 of the blade rail portion 80. When the power take-off is engaged, the rotation of the eccentric shaft 154 by the power take-off shaft 152 reciprocates the connecting rod 180 moving the blade rail portion 80 back and forth along an x axis. A typical range of motion is 0.1 to 0.5 inches along the x axis. The lengths of the eccentric shaft 154 and the range of reciprocating motion vary according to the embodiment.

Support Assembly

FIG. 6 shows the support assembly 22. The support assembly 22 defines a box-like nose structure 32 having a shelf 202 for supporting added weights 34. In one embodiment the shelf 202 is 0.75 inch thick steel supported by a pair of 0.75 inch thick steel plates 204, 206. A front plate 208, rear plate 210 and an lid plate 212 enclose the nose structure 32 and shelf 202. In one embodiment, the front plate 208, rear plate 210 and lid plate 212 are formed with 0.25 inch thick steel. In one embodiment the shelf 202 is 11 inches by 18 inches. The added weights are lead, zinc, steel or another dense heavy material. According to a preferred embodiment it is desirable to apply several hundred pounds of weight onto the blade portion 80 via the support assembly 22. Thus, thick steel plates and dense added weights are used. In one embodiment the box-like structure 32 with front plate 208, rear plate 210 and lid plate 212 weigh approximately 400 pounds and define a space to hold added weights of approximately 300 pounds. The specific dimensions and weight of the support assembly 22 vary with various embodiments with heavier weights preferable. Applied weight from the support assembly 22 and excess weight 34 of 400 pounds or more is preferred. In a best mode 700 pounds, as allotted above, is applied by the support assembly 22.

Often it is difficult to provide sufficient force for some floor cover removing tasks. According to an aspect of this invention, weight in excess of conventional loads are provided. Including the excess weight of support assembly 22 increases the force on the blade 30 and adds stability to the blade assembly 20 as the tractor wheels 18 rotate and drive the tractor 12 forward. To avoid damaging the floor substrate for softer substrates such as wood or soft concrete, the blade angle $\alpha$ is decreased in comparison to the angle used for harder floor substrates.

Figure 8:
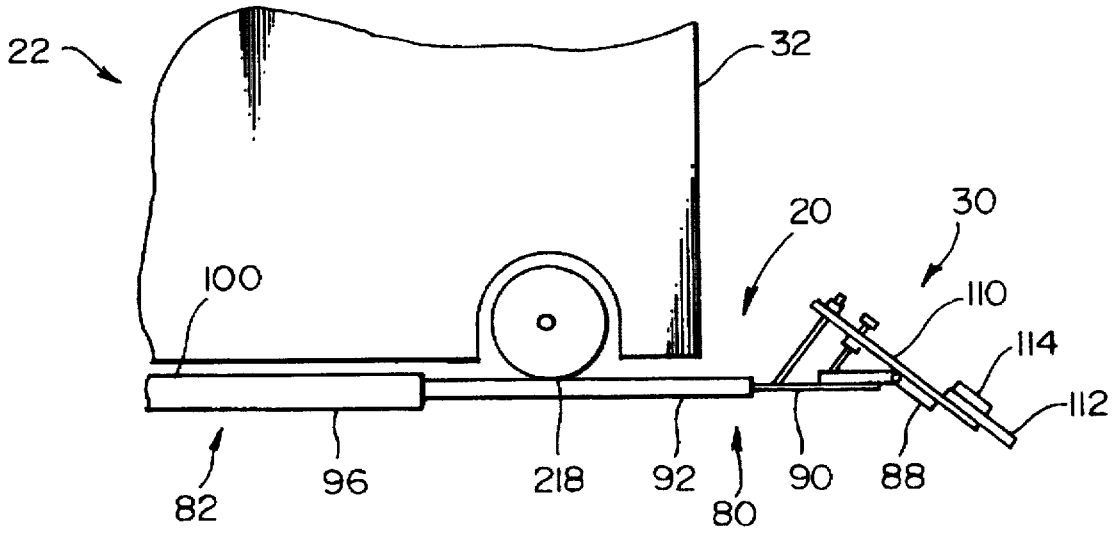
FIG. 8 is a partial planar view of the support assembly of FIG. 7 and the blade assembly of FIG. 3 showing a point of contact.

The support assembly 22 is mounted to the tractor body 21 or the elongated members 100, 102 of the blade assembly 22 to secure the support assembly 22 to the tractor 12. As shown in FIG. 8, the support assembly 22 also defines points of contact 218 with the reciprocating blade rail portion 80 of blade assembly 20. Each point of contact 218 occurs between a yoke roller 220 and an arm 92, 94. At a lower forward end of the support assembly 22 toward the blade 30 a roller 220 is mounted to side plate 204, while another roller 220 is mounted to side plate 206. The rollers 220 provide respective points at which the weight of the support assembly 22 is applied to the blade rail portion 80. As the blade rail portion 80 oscillates, the arms 92, 94 move relative to the rollers reciprocating along an x axis. The roller 220 avoids a tearing shear force on the arms 92, 94 during the oscillation. The roller 220 contact structure enables the floor covering removal apparatus 10 to apply excess weight onto the blade 30 without splitting or spreading the arms 92, 94. In effect, the roller contact structure allows increased effectiveness of the apparatus 10, while prolonging the useful life of such apparatus 10.

Figure 9:
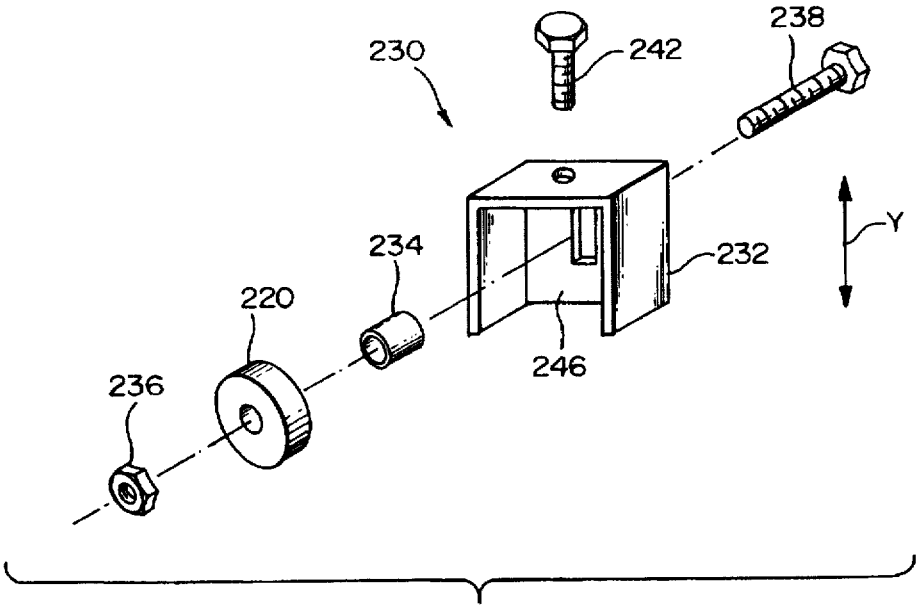
FIG. 9 is an exploded view of the roller bracket of the support assembly of FIG. 6.

Each yoke roller 220 is mounted to the box-like structure 32 via a roller bracket assembly 230. FIG. 9 shows the roller bracket assembly 30, including a yoke roller 220, a bracket 232, a bushing 234, nut 236, bolt 238, and jack screw 242. Each side plate 204, 206 defines an arch 244 exposing the roller 220. The bracket 232 is pressed to the arch and secured in place by the nut 236 and bolt 238. The bushing 234 spaces the roller 220 from a wall 246 of bracket 232. Jack screw 242 sets the height of the roller 220 relative to the bracket 232 and base 248 of the appropriate side plate 204/206. The jack screw 242 turns down through surface 250 of bracket 232 contacting bushing 234. Under the stress of the weight of the support structure 22, the jack screw 242 prevents the roller 220 from moving in a y direction. Movement in a y direction is undesirable because such motion would cause the lower edges 248 of side walls 204, 206 to come to rest on the tracks 96, 98 offsetting some of the weight preferably applied more directly onto arms 92, 94. Movement in a y direction is further undesirable because such motion might cause the lower edges 248 of side walls 204, 206 to come to rest on the arms 92, 94. Such contact would not provide the roller motion during reciprocation of the arms 92, 94 causing undesirable wear and tear on the arms 92, 94.

Lift Assembly

Figure 10:
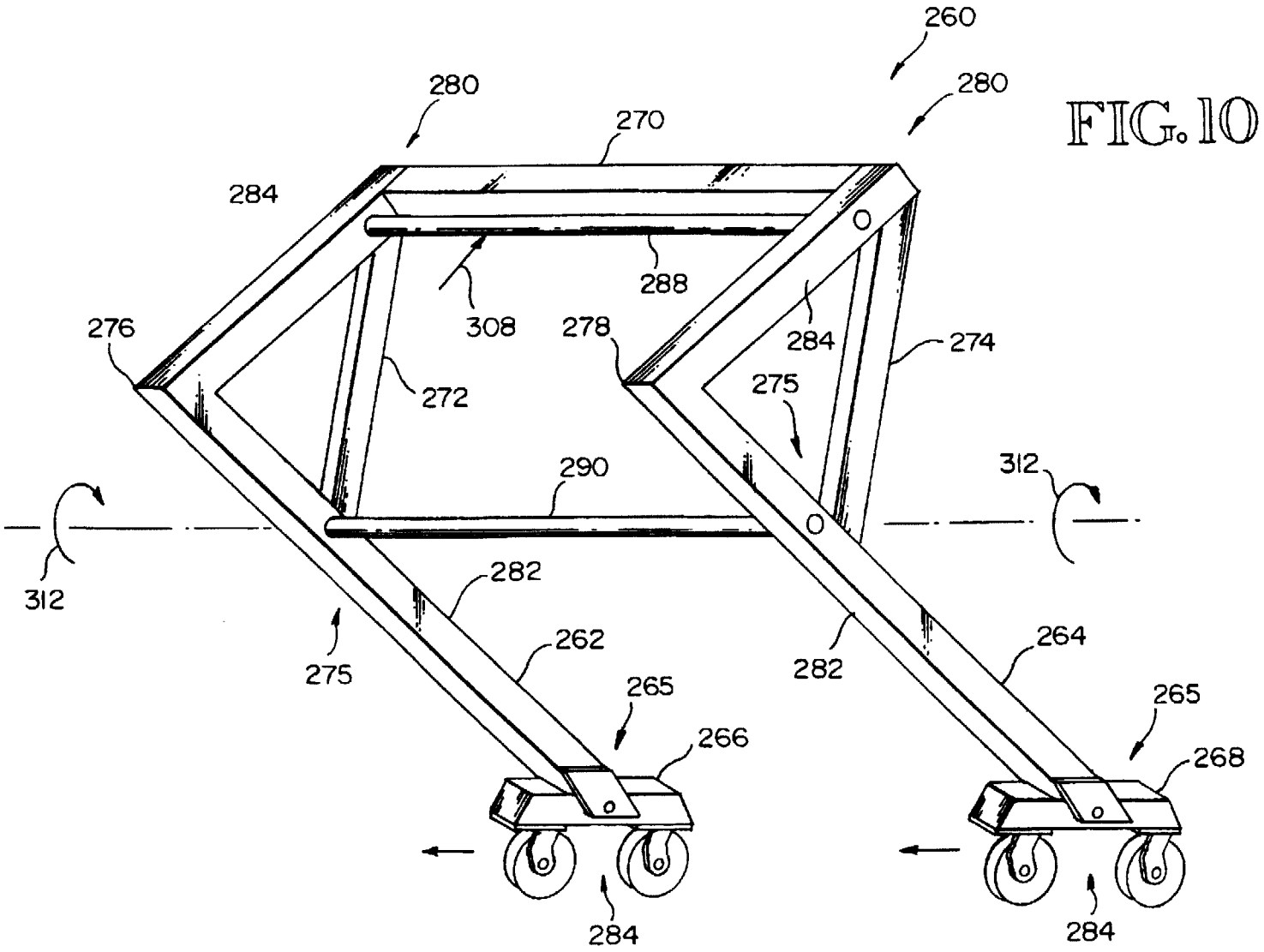
FIG. 10 is an isometric view of the frame portion of the lift assembly.

FIG. 10 shows a frame portion 260 of the lift assembly 24. The frame portion 260 includes a pair of legs 262, 264 on wheels mounts 266, 268, a cross beam 270, and supports 272, 274. Each leg 262, 264 extends from a first end 265 sitting upon a wheel mount 266, 268 along a first direction to a vertex 276/278 where the leg 262/264 bends at a right angle, then on to a second end 280. The cross beam 270 spaces the legs apart and connects the second ends 280 of each leg 262, 264. Supports 272, 274 extend from the second end 280 of each leg to a point 275 along the elongated leg portions 282. The supports 272, 274 maintain the relation between the upper leg portion 284 and lower leg portion 282 of each leg 262, 264. In one embodiment the legs 262, 264, cross beam 270 and supports 272, 274 are formed by 2" by 2" square tubing having a wall thickness of 0.25". Each leg 262, 264 is situated on each side of the support assembly 22 (see FIG. 1). To support the weight of the frame portion 260 and avoid undue moments of inertia upon a contact between the leg ends 265 and the wheel mounts 266, 268, the leg ends 265 and wheel mounts 266, 268 are in a common plane for a given leg 262/264. Such common plane includes the plane of the respective leg 262, 264. Each wheel mounts includes a pair of wheels 284.

Figure 7:
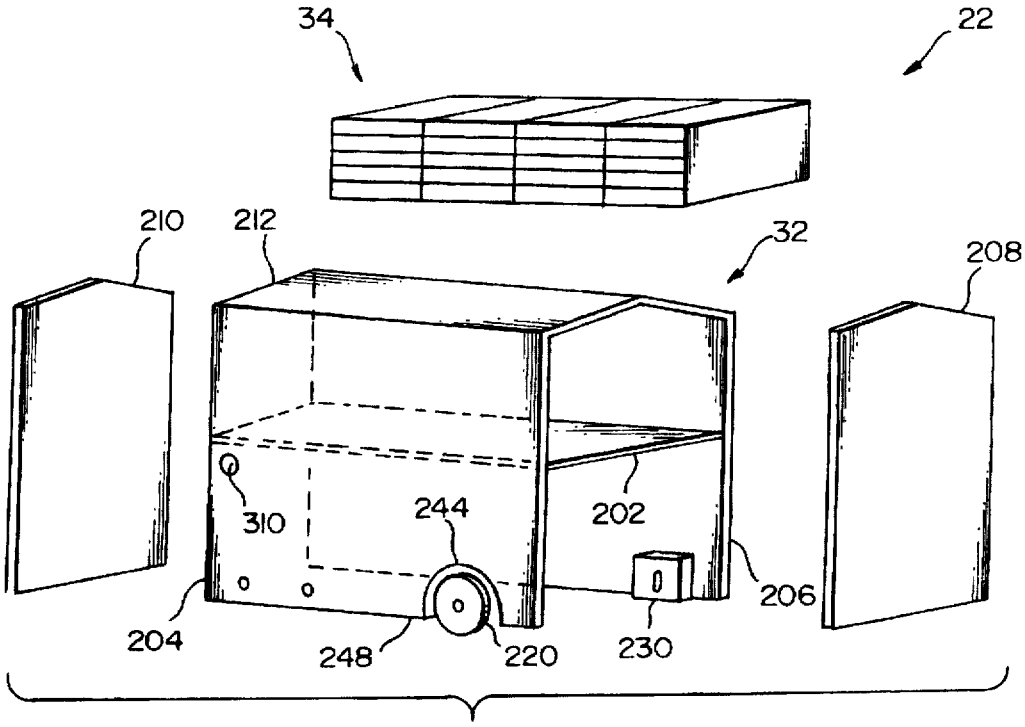
FIG. 7 is a partially exploded view of the support assembly of FIG. 1.

The frame portion 260 further includes a rod 288 and a rod 290. Rod 288 extends parallel with the cross-beam 270 from one leg 262 to the other leg 264 in the vicinity of the ends 280. Rod 290 extends similarly in parallel between the two legs 262, 264, but in the vicinity of point 275 along the lower leg portion 282. In one embodiment the rod 290 is fastened to the lower leg portions 282 at a point between the support contact point 275 and the vertex 276, but in the vicinity of points 275 of each leg 262, 264. The rod 290 passes through an opening 310 (see FIG. 7) in each side plate 204, 206 of the support assembly 22.

Figure 11:
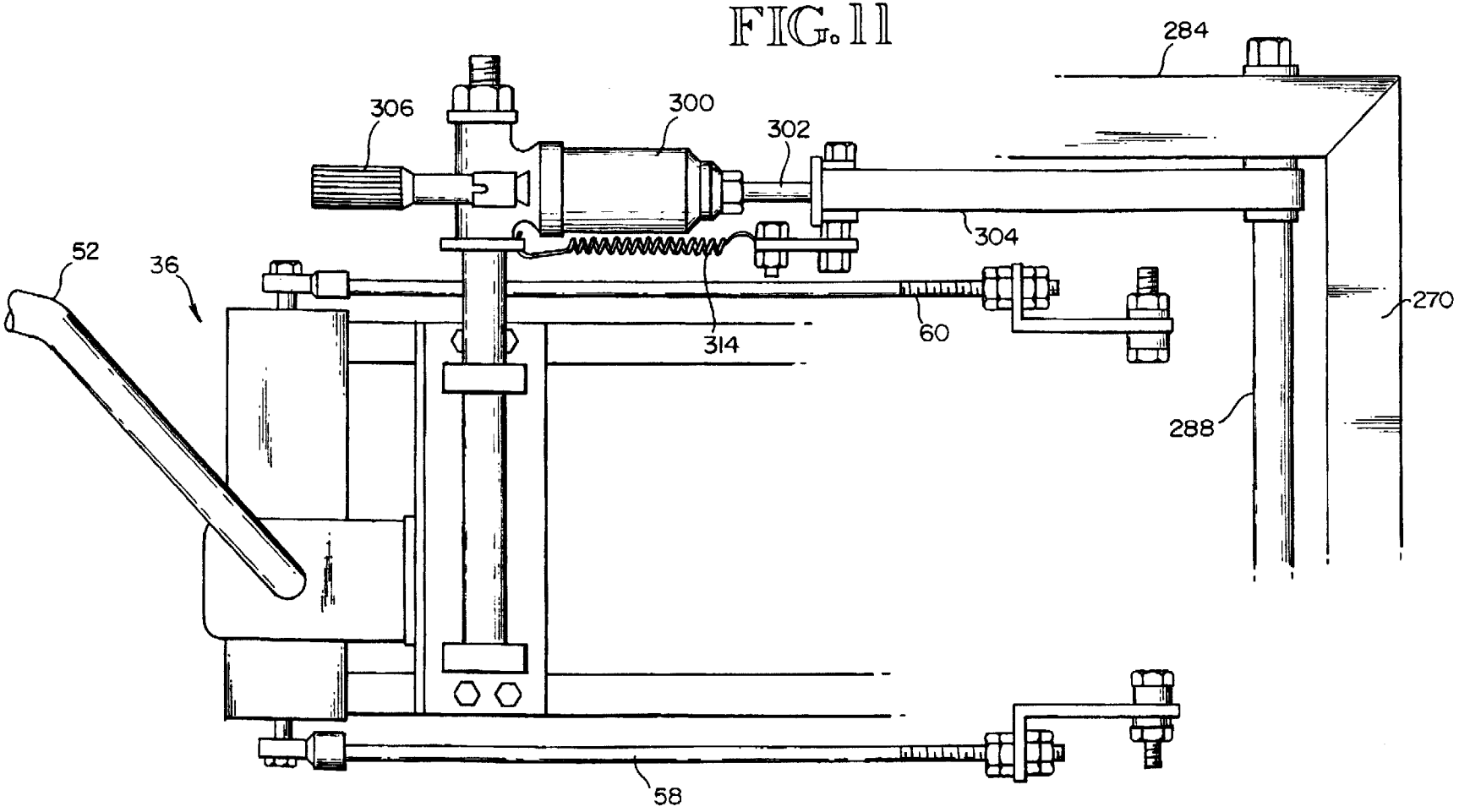
FIG. 11 is a partial planar view of the steering mechanism of the tractor of FIG. 2 and the lift assembly of FIG. 1.

As shown in FIG. 11, the lift assembly 24 also includes a hydraulic jack 300 having a ram 302 for pushing the rod 288 forward via a connecting rod 304. Referring to FIGS. 10 and 11, the jack 300 is pumped at a handle 306 causing a force 308 to be applied on rod 288. The other rod 290 defines an axis of rotation in response to the force 308 causing a rotation 312 of the frame portion 260. Such rotation moves the leg ends 265 and wheels 284 downward and back relative to the support assembly 22, blade assembly 20, tractor body 21 and tractor wheels 18. The wheels 284 enter in contact with the floor. As rotation continues, the legs 262, 264 raise the blade assembly 20, support assembly 22 and forward end of the tractor 12 relative to the tractor wheels and the floor substrate on which the apparatus 10 rests.

In one embodiment the jack 300 is adapted from an automotive floor jack. When the ram 302 is released the weight of the support assembly 22 reverses the rotation lowering the support assembly 22 and blade assembly 20 back toward the floor. Because a floor typically is not perfectly flat and has dips it is desirable to raise the wheels 284 off the floor during operation so that the wheels 284 do not absorb the weight of the support assembly 22 instead of the blade 30 when a dip in the floor occurs. To raise the wheels a spring 314 helps collapse the ram 302 back into the jack 300 when released. The spring 314 biases the frame portion 260 rotation back sufficiently to raise the wheels 284 off the floor. The position in which the support assembly 22 and blade assembly 20 are lowered enabling contact between the blade 30 and floor is referred to as an operating position. The position in which the support assembly 22 and blade assembly are raised lifting the blade 30 above the floor is referred to as an operating position.

Operation

The floor covering removal apparatus 10 of FIG. 1 extends approximately 4.5 feet in length allowing easy maneuverability. The apparatus 10 spans less than 30 inches in width allowing easy passing through conventional doorways. In one embodiment the tractor 12 is fitted with a propane fuel source 70 to avoid the fumes of conventional gasoline and diesel powered tractor engines. This further improves the use of the apparatus 10 indoors. When preparing the apparatus 10 for use, the blade 30 is raised to the non-operating position allowing easier maneuverability of the apparatus without catching the blade along the floor. While in the raised non-operational position, an operator adjusts the blade angle to a desired position. The operator then releases the jack 300 lowering the blade into the operating position. The operator then steers the tractor as the clutch is disengaged causing the apparatus 10 to move forward. As the apparatus 10 moves forward, the blade 30 wedges between floor covering FC and the floor substrate FS. With sufficient force applied through the blade 30 the floor covering is stripped from the floor substrate. The weight applied to the blade 30 via the support assembly 22 increases the force of the blade 30 and stabilizes the tractor 12 motion as the apparatus 10 moves forward. If removal is not proceeding satisfactorily, the operator raises the blade 30 to the non-operating position then adjusts the blade angle to improve performance. Such adjustment is either to increase or decrease the blade angle depending on the performance. In one embodiment, adjustment of the blade angle is performed to accommodate softer floors, rather than the removal of weight from within the support assembly 22. Even with the weight of the tractor 12 and support assembly 22, the blade angle adjustment is able to accommodate soft floor substrates such as wood and remove floor covering without damage (attributable to the apparatus 10).

Meritorious and Advantageous Effects

According to one advantage of the invention, the floor covering removal apparatus is of a desirable size for operating in indoor areas. According to another advantage of the invention, the floor covering removal apparatus has a weighted front for increasing the force on the blade as floor covering is removed. According to another aspect of the invention, the points of contact at which the excess weight is applied to the blade assembly are made at rollers allowing movement of the points of contact laterally without damage to the component structures. According to another advantage of the invention, the blade is raised to improve maneuverability when floor covering os not being removed. According to another advantage of the invention, the blade angle although set during operation, is adjustable to provide effective performance for various floor substrates and floor covering materials.

Although a preferred embodiment of the invention has been illustrated and described, various alternatives, modifications and equivalents may be used. For example, the specific dimensions, weights and materials may be changed. Therefore, the foregoing description should not be taken as limiting the scope of the inventions which are defined by the appended claims.

What is claimed is:

1. A floor covering removal apparatus in connection with a tractor, comprising in combination:

a tractor body;

a plurality of wheels mounted to the tractor body;

a motor mounted to the tractor body for driving the plurality of wheels;

a blade assembly coupled to the tractor body at a forward portion of the tractor body, the blade assembly comprising a blade for contacting floor covering to be removed from a floor; and a support assembly having at least a first contact point and a second contact point with the blade assembly for applying weight onto the blade assembly, the support assembly comprising a first roller defining the first contact point and a second roller defining the second contact point, wherein the first contact point and second contact point are movable along the blade assembly.

2. The combination of claim 1, in which the motor has a power take-off, and further comprising means for oscillating the blade, said oscillating means coupled to the blade assembly and the power take-off of the motor, and wherein the first contact point and second contact point move along the blade assembly during oscillation of the blade.

3. The combination of claim 1, in which the blade assembly further comprises:

a hinge to which the blade is attached;

a base plate to which the hinge is attached, wherein an angle is formed between the base plate and blade by the hinge, said angle being adjustable;

a first arm fixedly connected to the base plate;

a second arm fixedly connected to the base plate;

a first track for receiving the first arm, the first track being secured to the tractor body; and a second track for receiving the second arm, the second track being secured to the tractor body.

4. The combination of claim 3, in which the blade comprises a first plate connected to a second plate, the first plate defining a distal edge for contacting the floor covering, the second plate being attached to the hinge; and wherein the blade assembly further comprises:

a first bolt extending from the base plate through the second plate where the first bolt is locked into position to define said angle and to prevent variation of said angle in a first direction during operation; and a second bolt extending through the second plate to the base plate to prevent variation of said angle in a second direction counter to said first direction.

5. The combination of claim 3, wherein the support assembly first contact point is movable along the first arm of the blade assembly and the support assembly second contact point is movable along the second arm of the blade assembly.

6. The combination of claim 1, in which the support assembly further comprises:

a support surface elevated relative to the blade assembly;

added weight applied onto the shelf;

a first support to which the first roller is mounted for supporting the support surface relative to the blade assembly; and a second support to which the second roller is mounted for supporting the support surface relative to the blade assembly; and wherein the support assembly applies a weight in excess of 400 pounds onto the blade assembly.

7. The combination of claim 6, further comprising means for lifting the support assembly and blade assembly to move the blade into a raised position out of contact with the floor and floor covering, the lifting means comprising:

a frame comprising a first leg and a second leg connected by a cross beam;

a first bar extending from the first leg to the second leg and defining an axis of rotation for the frame, the first bar being coupled to the tractor and support assembly;

a first wheel coupled to the first leg at a distal portion of the first leg;

a second wheel coupled to the second leg at a distal portion of the second leg;

a second bar extending from the first leg to the second leg;

means for moving the second bar toward the forward end of the tractor causing a rotation of the frame about the frame axis of rotation and forcing the first wheel and second wheel downward toward the floor and driving the forward end of the tractor with the support assembly and the blade assembly upward from the floor to shift a weight force from the blade to the first wheel and second wheel.

8. The combination of claim 1, further comprising means for lifting the support assembly and blade assembly to move the blade into a raised non-operational position out of contact with the floor and floor covering.

9. A floor covering removal apparatus in connection with a tractor, comprising in combination:

a tractor body;

a plurality of wheels mounted to the tractor body;

a motor mounted to the tractor body for driving the plurality of wheels, the motor having a power take-off;

a blade assembly coupled to the tractor body at a forward portion of the tractor body, the blade assembly comprising: (a) a blade for contacting floor covering to be removed from a floor; (b) a base plate to which the blade is adjustably coupled, an adjustable angle is formed between the base plate and blade; (c) a first arm fixedly connected to the base plate; (d) a second arm fixedly connected to the base plate; (e) a first track for receiving the first arm, the first track being secured to the tractor body; and (f) a second track for receiving the second arm, the second track being secured to the tractor body;

a support assembly having at least a first contact point and a second contact point with the blade assembly for applying weight onto the blade assembly, the support assembly comprising a first roller defining the first contact point and a second roller defining the second contact point, wherein the first contact point is movable along the first arm of the blade assembly and the second contact point is movable along the second arm of the blade assembly; and means for oscillating the blade, said oscillating means coupled to the blade assembly and the power take-off of the motor, and wherein the first contact point and second contact point move along the blade assembly during oscillation of the blade.

10. The combination of claim 9, in which the support assembly further comprises:

a support surface elevated relative to the blade assembly;

added weight applied onto the shelf;;

a first support to which the first roller is mounted for supporting the support surface relative to the blade assembly; and a second support to which the second roller is mounted for supporting the support surface relative to the blade assembly; and wherein the support assembly applies a weight in excess of 400 pounds onto the blade assembly.

11. The combination of claim 10, further comprising means for lifting the support assembly and blade assembly to move the blade into a raised position out of contact with the floor and floor covering, the lifting means comprising:

a frame comprising a first leg and a second leg connected by a cross beam;

a first bar extending from the first leg to the second leg and defining an axis of rotation for the frame, the first bar being coupled to the tractor an support assembly;

a first wheel coupled to the first leg at a distal portion of the first leg;

a second wheel coupled to the second leg at a distal portion of the second leg;

a second bar extending from the first leg to the second leg;

means for moving the second bar toward the forward end of the tractor causing a rotation of the frame about the frame axis of rotation and forcing the first wheel and second wheel downward toward the floor and driving the forward end of the tractor with the support assembly and the blade assembly upward from the floor to shift a weight force from the blade to the first wheel and second wheel.

12. The combination of claim 9, further comprising means for lifting the support assembly and blade assembly to move the blade into a raised non-operational position out of contact with the floor and floor covering.

* * * * *